United States Patent [19]

Force

[11] 4,206,007

[45] Jun. 3, 1980

[54] PROCESS FOR CARPET MANUFACTURE

[75] Inventor: Carlton G. Force, Mount Pleasant, S.C.

[73] Assignee: Westvaco Corporation, New York, N.Y.

[21] Appl. No.: 962,002

[22] Filed: Nov. 20, 1978

[51] Int. Cl.[2] ..... A46D 1/00; B32B 5/00; D05C 15/00

[52] U.S. Cl. ..... 156/72; 156/334; 156/337; 260/28.5 R; 260/23 S; 427/373

[58] Field of Search ..... 427/373, 336, 209, 384, 427/207 A, 385 R; 260/235, 285 R; 156/72, 334, 337

[56] References Cited

U.S. PATENT DOCUMENTS

| | | | |
|---|---|---|---|
| 3,718,530 | 2/1973 | Watson | 156/72 X |
| 3,798,118 | 3/1974 | Jones | 156/334 X |

FOREIGN PATENT DOCUMENTS

| | | | |
|---|---|---|---|
| 1079757 | 8/1967 | United Kingdom | 156/72 X |

*Primary Examiner*—Michael R. Lusignan
*Attorney, Agent, or Firm*—Ernest B. Lipscomb, III; Terry B. McDaniel

[57] ABSTRACT

An improved process is disclosed for manufacturing carpet. The improved process involves replacing from 4% to 25% of a carboxylated styrene-butadiene rubber carpet backing adhesive in a conventional carpet manufacturing process with a water soluble saponified tall oil pitch tackifier, thereby improving the bond strength between the carpet and backing.

18 Claims, No Drawings

PROCESS FOR CARPET MANUFACTURE

BACKGROUND OF THE INVENTION (1) Field of the Invention

This invention relates to an improved process for carpet manufacture. More particularly, this invention relates to an improved carpet manufacturing process employing a carboxylated styrene-butadiene rubber (SBR) adhesive whereby the improvement comprises forming a mixture of from 4% to 25% by dry weight saponified tall oil pitch and from 96% to 75% by dry weight carboxylated SBR to enhance the tack and final bond strength of the rubber adhesive. Fillers can also be included in the mixture as well as other ingredients.

(2) Description of the Prior Art

For many years the production of backsized tufted carpet has been accomplished by an aqueous latex method. This method involves preparing a tufted structure by stitching a primary backing material with yarn in such a manner as to form on the top surface of the material a pile composed of numerous closely spaced erect loops of fiber bundles, i.e., tufts of yarn. If desired, the loops can be cut. After forming the tufted structure, the bottom surface thereof is coated with a latex containing a polymer binder such as a styrene-butadiene copolymer and a secondary backing material is applied thereto. The structure is then passed through an oven to dry the latex. By such a process, the tufts of yarn and secondary backing material are bonded to the primary backing material. Also, the individual fiber filaments making up a fiber bundle are bonded together at the primary backing material.

The proccess of this invention may employ a latex foam backing in place of a secondary backing wherein the raw tufted carpet is pre-coated so that the latex is dried by passing through an oven prior to applying the foam to the underside, or latex coated side, of the carpet. After applying the foam backing, the carpet is passed again through a high temperature zone to cure the foam.

The foam backing may be applied via either the "gelled" or "no-gelled" systems. The gelled system includes in the foam formulation a gelling agent, such as ammonium acetate which, upon exposure to infrared heat, gels the foam for curing. Whereas, the no-gelled system does not contain a gelling agent. That system employs a surfactant which promotes excessive colloid stability which, in turn, maintains the foam during curing.

SBR has a relatively low polarity compared to other synthetic rubbers; and unlike natural rubber, SBR does not develop surface peroxidal activity upon mastication. Therefore, SBR has relatively poor inherent or processed tack. An adhesive is said to possess tack if, under the conditions of application, only light pressure is required to produce a bond sufficiently strong to require work to restore the interface to its original separated state. Poor tack in SBR can be overcome by: (1) reducing the molecular weight or changing the molecular weight distribution, (2) decreasing the viscosity with plasticizer or surface treating with solvent, or (3) adding tackifiers, such as resins or natural rubber.

It has been known for several years that incorporation of a very small percent of an unsaturated fatty acid monomer with styrene or styrene and butadiene improves the adhesive properties of the resulting polymer (i.e., Netherlands Application 6,411,493, Apr. 15, 1965—acrylic acid and fumaric acid and German Offenlegungschrift No. 2,437,365, Feb. 13, 1975—itaconic). Also, methacrylic and crotonic acids are suited to this purpose. In addition to improving adhesion, carboxylation provides reaction sites for cross-linking with curing agents to improve water resistance and improves processing properties. Thus, carboxylated polystyrene or styrene-butadiene rubber latex has been the backbone of many water-based adhesives for some time. Just as natural rubber is added to SBR to improve its tack (German Offenlegungschrift No. 2,005,244, Aug. 6, 1970), addition of natural rubber latex to the carboxylated latex increases the wet grab (green tack) of the adhesive system.

In the process described above, the tufted carpet industry depends on highly filled carboxylated styrene-butadiene rubber latex to simultaneously bond the carpet tufts to the primary backing through which they are punched and adhere a secondary backing or a foam backing to the bottom of the carpet. Due to the high cost of natural rubber latex, the natural latex gradually has been removed from this adhesive system. A typical composition is as follows:

| | Parts Dry Weight |
|---|---|
| Carboxylated SBR (45% to 60% styrene) | 100 |
| Filler | 400 |
| Antioxidant | 1–2 |
| Thickener | 0.5 |
| Water to adjust final solids | |

Adhesive solids are normally in the range of 70% to 85%. The filler portion of the formulation may contain more than one type. Whiting (calcium carbonate) is the most common filler. Certain systems contain alumina trihydrate (ATH) to meet the fire retardant standard.

With the carboxylated SBR latex alone, unaided by the natural latex, wet grab to the secondary backing is borderline. If the secondary backing separates from the carpet at any stage of drying, the final bond will never be as strong as if a coherent system were retained throughout the drying cycle. For this reason, the carpet industry, in particular, is interested in more economic methods of increasing the green tack of the carboxylated SBR adhesive, thereby enhancing the final bond of carpet to backing.

Therefore, it is an object of this invention to provide an improved carpet manufacturing process employing a carboxylated styrene-butadiene rubber adhesive wherein the improvement comprises replacing 4% to 25% of the rubber with saponified tall oil pitch to improve the bond of the carpet and primary and secondary backing materials. Another object of this invention is to provide an improved carpet manufacturing process wherein the green tack of the carboxylated styrene-butadiene rubber adhesive is improved. Still another object of this invention is to provide an improved process for carpet manufacture wherein the improvement comprises replacing 4% to 25% of carboxylated SBR with saponified tall oil pitch to increase the volume of the adhesive over the volume produced with carboxylated SBR alone, due to enhanced ability of the adhesive to incorporate air. The advantages obtained are good coverage at lower application weights and lower application cost per square yard (as air is used to extend the adhesive material).

SUMMARY OF THE INVENTION

It has been found that by replacing from 4% to 25% (6% to 9% preferred) of carboxylated SBR latex adhesive with a saponified tall oil pitch in a carpet manufacturing process, the green tack of the adhesive is improved, the bond of the carpet to primary backing material to secondary backing material is improved, and the total volume of adhesive is increased, due to frothing induced by the saponified pitch.

DESCRIPTION OF THE PREFERRED EMBODIMENT

The practice of the invention comprises first forming a carpet backing adhesive of from 96% to 75% by dry weight of a carboxylated styrene-butadiene rubber latex, preferably from 94% to 91%, and from 4% to 25% by dry weight of a saponified tall oil pitch, preferably from 6% to 9%. Carboxylated SBR is SBR which contains carboxyl functions introduced by incorporation of a suitable monomer, such as acrylic acid, fumaric acid, itaconic acid, etc. The carboxylated latex should contain 40% to 60% solids, preferably 50% to 55%, and from 45% to 60% styrene, preferably 50%. Saponified tall oil pitch is the distillation residue from the distillation of crude tall oil to extract fatty acids and rosin which residue (pitch) has been subjected to saponification. One such saponification of tall oil pitch process is described in U.S. Pat. No. 3,943,117. If necessary, a sufficient amount of water is added to make the solids content of the mixture from 70% to 85%, preferably 82%. To this mixture may be added up to 600 parts of filler material, per 100 parts dry weight of carboxylated SBR plus saponified tall oil pitch. Typical of such filler material are calcium carbonate ($CaCO_3$) and alumina trihydrate (ATH) or a combination of the two, wherein the ratio of ATH to $CaCO_3$ is from 3:1 to 1:2. The mixture is complete upon adding an amount of a polymeric thickener, such as a polyacrylate, sufficient to increase the viscosity of the mixture to from 15,000 to 20,000 centipoise.

The bottom, nonpile surface of a raw tufted carpet, i.e., the underside of the primary backing material, is then coated evenly with from 6 to 35 ounces per square yard, preferably 32 ounces per square yard, of the thus formed carpet backing latex adhesive. The primary backing material can be either jute or a woven polypropylene material. Next, a secondary backing material is applied to the coated backside of the carpet by pressing with a roller. The secondary backing material can be either jute or a woven polypropylene material.

Finally, the carpet is passed into a heating section, or oven, at from 125° C. to 160° C., preferably 135° C., for up to 20 minutes whereby the primary backing and secondary backing materials are firmly bonded to each other and the base of each loop in the pile is firmly bonded to the primary backing.

The practice of the invention is clearly illustrated in the following examples.

EXAMPLE 1

Latex carpet backing adhesives were prepared containing 0, 6, 7, 8, 9, 10, 12 and 15 percent by dry weight, of saponified tall oil pitch (Westvaco CUSTOFAC® CS) and 100, 94, 93, 92, 91, 90, 88 and 85 percent, respectively, by dry weight of a carboxylated SBR latex (Firestone FR-S 256). The latex and saponified pitch were blended by heating to less than 50° C. with agitation. Water was added to make up for water loss during heating and to adjust the solids content of the final product to 82%. While stirring, $CaCO_3$ was gradually added in the amount of 400 parts dry weight per 100 parts dry weight of the rubber plus saponified pitch. The viscosity of the mixture was increased to from greater than 16,000 to less than 20,000 centipoise in each sample by the dropwise addition of a polyacrylate thickener (Rockmart RH 46). Viscosity measurements were obtained using a Brookfield RVH Viscometer, spindle #5, at 10 RPM.

Rectangles, fourteen-inches by eight-inches, of both raw tufted carpet (in a woven polypropylene primary backing material) and jute were cut for each formulation prepared. Approximately 72 grams of the latex adhesive were spread on the 14-inch by 6-inch portion of the underside of the carpet (32 ozs./yd.$^2$). Next, the secondary jute backing was applied against the latex adhesive and the sample was rolled with an iron shaft (22½ inches long, ⅞ inch in diameter, and weighing 1,739.4 grams) once across the width and once from the center to each side across the length of each sample. The sample was then placed in a 135° C. oven to cure.

Two-inch by eight-inch strips were cut after 3, 5, 7, 9, 11 and 15 minutes heating. After removal from the oven and cutting, each strip was tested immediately in a Scott Tester, Model No. L5, to measure the strength of the bond. The remaining 2-inch by 8-inch strip was removed from the oven after 15 minutes, cooled slightly, and saturated with water. The bond of the wet sample was also measured with the Scott Tester. The results are reported in Table I.

TABLE I

COMPARISONS OF VARIOUS AMOUNTS OF SAPONIFIED TALL OIL PITCH IN LATEX CARPET BACKING

| Saponified Tall Oil Pitch (%) | Average Weight Spread (g) | Viscosity (cps) | Mean Bond Strength Minutes in Oven 3 | 5 | 7 | 9 | 11 | 15 | Wet | Total |
|---|---|---|---|---|---|---|---|---|---|---|
| 0 | 71.2 | 18400 | 9.3 | 11.5 | 14.8 | 18.4 | 11.75 | 13.1 | 24.1 | 14.7 |
| 6 | 75.4 | 19720 | 9.75 | 20.25 | 39.2 | 20.5 | 18.4 | 17.9 | 43.9 | 24.3 |
| 7 | 73.8 | 18800 | 12.3 | 16.25 | 22.5 | 17.2 | 18.5 | 14.9 | 56.7 | 22.6 |
| 8 | 72.7 | 17080 | 14.3 | 14.6 | 15.9 | 18.1 | 15.8 | 13.9 | 49.0 | 20.2 |
| 9 | 72.7 | 18880 | 12.25 | 19.6 | 16.9 | 19.0 | 18.4 | 18.7 | 57.2 | 23.1 |
| 10 | 69.2 | 19800 | 10.6 | 12.7 | 11.0 | 20.25 | 18.2 | 11.2 | 35.3 | 17.0 |
| 12 | 75.6 | 18800 | 4.6 | 8.3 | 15.1 | 17.6 | 11.6 | 15.75 | 44.3 | 16.75 |
| 15 | 77.1 | 16160 | 1.0 | 8.3 | 14.0 | 12.8 | 15.25 | 17.75 | 55.1 | 17.75 |

Addition of saponified tall oil pitch improved both the initial tack and final adhesion of the carboxylated SBR latex carpet backing. Table I shows mean values obtained for the bond strength between the carpet and the jute backing. Every level of replacement by saponified pitch gave bond strengths which were higher than with carboxylated SBR alone. Replacement of 15% rubber with saponified tall oil pitch continues to give improved final bond strength. Replacement of 6% to 10% carboxylated SBR with saponified tall oil pitch gives green tack and adhesion values generally higher than carboxylated SBR alone. The optimum range is 6% to 9% saponified pitch as more of these values are significantly higher. Improved adhesion was achieved in every case in the wet sample.

EXAMPLE 2

During evaluation of the tackifying properties of saponified tall oil pitch, it was noted that upon preparing identical dry weight amounts of the control formulation (carboxylated SBR alone) and experimental formulations (carboxylated SBR plus amounts of saponified tall oil pitch) greater volumes of the experimental formulations were produced upon agitation to mix the constituents. To measure this increase in volume, apparently due to frothing from enhanced air entrainment, and to evaluate the formulation's ability to retain the increase in volume over weight, the following samples were prepared:

| | Control | | Experimental | |
|---|---|---|---|---|
| | Dry Wt (g) | Wet Wt. (g) | Dry Wt. (g) | Wet Wt. (g) |
| Carboxylated SBR Latex | 100 | 193.4 | 92 | 177.9 |
| Saponified Tall Oil Pitch | — | — | 8 | 12.7 |
| $CaCO_3$ | 400 | 400.0 | 400 | 400.0 |
| Distilled Water | — | 16.4 | — | 19.2 |
| Total Weight | 500 | 609.8 | 500 | 609.8 |

Each sample was blended for 10 minutes and polyacrylate thickener was added to each to increase their viscosities to the 15,000 to 20,000 centipoise range. The volume to weight ratios were calculated after adjusting the viscosities, after standing overnight, after being continuously shaken over a second night, and after being continuously shaken over three more days. The results are presented in Table II.

TABLE II

COMPARISONS OF VOLUME TO WEIGHT RATIOS IN LATEX CARPET BACKING WITH 0% AND 8% SAPONIFIED TALL OIL PITCH

| Treatment | Control (ml/g) | Experimental (ml/g) |
|---|---|---|
| Initial Formulation | 0.5896 | 0.6234 |
| Overnight on Shelf | 0.5897 | 0.6095 |
| Shaken over 2nd Night | 0.6668 | 0.7383 |
| Shaken over 3rd, 4th & 5th Nights | 0.6207 | 0.8015 |

From this example, it can be seen that due to the increase in volume for the same weight of materials, the addition of saponified tall oil pitch not only provides improved green tack and final bond strength, it would allow good coverage at lower application weights. With little or no filler, as low as 6 ounces per square yard rather than the normal 16 to 24 ounces per square yard can be effectively employed. With substantial filler the adhesive material requirements can be reduced from 25 to 35 ounces per square yard to about 15 ounces per square yard.

While the invention has been described and illustrated herein by references to various specific materials, procedures and examples, it is understood that the invention is not restricted to the particular materials, combinations of materials, and procedures selected for that purpose. Numerous variations of such details can be employed, as will be appreciated by those skilled in the art.

What is claimed is:

1. An improved process for the manufacture of carpet including the steps of (a) forming a mixture of up to 600 parts dry weight of filler material per 100 parts dry weight of carboxylated styrene-butadiene rubber latex, (b) adding an amount of a polyacrylate thickener sufficient to increase the viscosity of the mixture to from 15,000 to 20,000 centipoise, (c) coating evenly the bottom nonpile surface of a raw tufted carpet on a primary backing with the mixture, (d) applying a secondary backing material to the coated back side of the carpet by pressing with a roller, and (e) passing the thus formed carpet into a heating section whereby the primary backing and secondary backing materials are firmly bonded to each other and the base of each loop in the pile is firmly bonded to the primary backing, wherein the improvement comprises replacing from 4% to 25% of the rubber, prior to forming the mixture of step (a), with a saponified tall oil pitch tackifier, adding water to adjust the solids content of the rubber plus saponified tall oil pitch mixture to from 70% to 85% and the amount of the filler material added is up to 600 parts dry weight per 100 parts dry weight of the rubber plus saponified tall oil pitch.

2. The improved process of claim 1 wherein the primary backing is a woven polypropylene material and the secondary backing material is jute.

3. The improved process of claim 1 wherein the primary backing material is jute and the secondary backing is a woven polypropylene material.

4. The improved process of claim 1 wherein the primary backing material and the secondary backing material are jute.

5. The improved process of claim 1 wherein the primary backing material and the secondary backing material are a woven polypropylene material.

6. The improved process of claim 1 wherein the carboxylated styrene-butadiene rubber latex has a solids content of from 40% to 60%.

7. The improved process of claim 1 wherein the filler material is added in the amount of 400 parts dry weight per 100 parts dry weight of the rubber plus saponified tall oil pitch.

8. The improved process of claim 7 wherein the carpet is coated with from 15 to 35 ounces per square yard and the carpet is passed into the heating section at from 125° C. to 160° C. for up to 20 minutes.

9. The improved process of claim 2, 3, 4, 5, 6, 7 or 8 wherein the saponified tall oil pitch replaces from 6% to 9% of the rubber.

10. The improved process of claim 1 or 7 wherein the filler material is $CaCO_3$.

11. The improved process of claim 1 or 7 wherein the filler material is ATH.

12. The improved process of claim 1 or 7 wherein the filler material is ATH and $CaCO_3$ in the ratio from 3:1 to 1:2.

13. An improved process for the manufacture of carpet including the steps of (a) forming a mixure of up to 600 parts dry weight of filler material per 100 parts dry weight of carboxylated styrene-butadiene rubber latex, (b) adding an amount of a polyacrylate thickener sufficient to increase the viscosity of the mixture to from 15,000 to 20,000 centipoise, (c) pre-coating evenly the bottom nonpile surface of a raw tufted carpet on a primary backing with the mixture, (d) passing the thus pre-coated carpet into a heating section whereby the base of each loop in the pile is firmly bonded to the primary backing, (e) applying a latex foam to the latex-coated underside of the carpet, and (f) passing the thus formed carpet into a heating section whereby the pre-coat and foam backings are firmly bonded to each other, wherein the improvement comprises replacing from 4% to 25% of the rubber, prior to forming the mixture of step (a), with a saponified tall oil pitch tackifier, adding water to adjust the solids content of the rubber plus saponified tall oil pitch mixture to from 70% to 85% and the amount of filler material added is up to 600 parts dry weight per 100 parts dry weight of the rubber plus saponified tall oil pitch.

14. The improved process of claim 13 wherein the primary backing is a woven polypropylene material.

15. The improved process of claim 13 wherein the primary backing is jute.

16. The improved process of claim 13 wherein the foam backing is applied using the gelled system.

17. The improved process of claim 13 wherein the foam backing is applied using the no-gelled system.

18. The improved process of claim 13 wherein the carboxylated styrene-butadiene rubber latex has a solids content of from 40% to 60%.

* * * * *